US010427854B2

(12) United States Patent
Usami

(10) Patent No.: US 10,427,854 B2
(45) Date of Patent: Oct. 1, 2019

(54) SYNTHETIC RESIN CONTAINER

(71) Applicant: Tetsuro Usami, Tokyo (JP)

(72) Inventor: Tetsuro Usami, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 82 days.

(21) Appl. No.: 15/368,318

(22) Filed: Dec. 2, 2016

(65) Prior Publication Data

US 2017/0183138 A1 Jun. 29, 2017

(30) Foreign Application Priority Data

Dec. 25, 2015 (JP) ..... 2015-255230
Sep. 23, 2016 (JP) ..... 2016-185915

(51) Int. Cl.
*B65D 79/00* (2006.01)
*B65D 1/02* (2006.01)

(52) U.S. Cl.
CPC ..... *B65D 79/005* (2013.01); *B65D 1/023* (2013.01); *B65D 1/0223* (2013.01); *B65D 1/0276* (2013.01); *B65D 2501/0018* (2013.01)

(58) Field of Classification Search
CPC .... B65D 79/005; B65D 1/0276; B65D 1/023; B65D 2501/0018
See application file for complete search history.

(56) References Cited

U.S. PATENT DOCUMENTS 8,113,368 B2 2/2012 Oguchi et al.
2013/0213979 A1* 8/2013 Pedmo ..... B65D 1/42 220/600

FOREIGN PATENT DOCUMENTS

JP 2013-095428 A 5/2013
JP 5321814 B2 10/2013
JP 2015-048126 A 3/2015

OTHER PUBLICATIONS

Dec. 27, 2017 Office Action issued in Canadian Patent Application No. 2,950,488.
May 9, 2018 Office Action issued in Canadian Patent Application No. 2,950,488.

* cited by examiner

*Primary Examiner* — Andrew T Kirsch
*Assistant Examiner* — Don M Anderson
(74) *Attorney, Agent, or Firm* — Oliff PLC

(57) ABSTRACT

Provided is a synthetic resin container that effectively absorbs the reduced pressure generated inside the container as a result of hot filling and that also prevents deterioration in appearance of a label applied to an outer circumferential surface of a trunk portion of the container. A synthetic resin container according to the present disclosure includes a mouth portion, a trunk portion, and a bottom portion. The trunk portion is provided with a plurality of reduced pressure absorbing panels extending in the vertical direction while twisting in the circumferential direction and being arranged side by side in the circumferential direction. Each reduced pressure absorbing panel has a narrow-width portion located in a region between the panel upper end and the panel lower end. A width of each reduced pressure absorbing panel is reduced in the narrow-width portion than in the panel upper end and the panel lower end.

17 Claims, 5 Drawing Sheets

A-A section

B-B section

FIG. 3A

| | | Comparative Example 1 | | Example | | Comparative Example 2 | | Comparative Example 3 | |
|---|---|---|---|---|---|---|---|---|---|
| | | 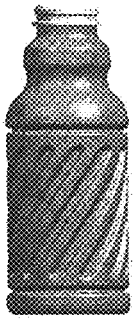 | | 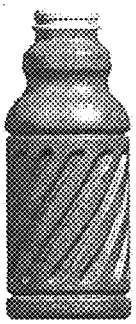 | | 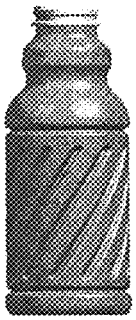 | | 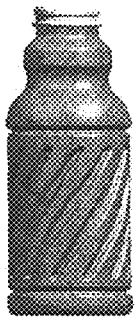 | |
| Absorption capacity | | 29.7 | | 22.5 | | 22.7 | | 30.5 | |
| Wrinkles on label | | Bad | | Good | | Good | | Bad | |
| Mold release properties | | Good | | Good | | Bad | | Bad | |
| Panel widths (upper and lower ends) | | Wide | | Wide | | Narrow | | Narrow | |
| a | b | 8.8mm | 4.3mm | 8.8mm | 4.3mm | 5.0mm | 2.0mm | 5.0mm | 2.0mm |
| Panel widths (middle position) | | Wide | | Narrow | | Narrow | | Wide | |
| a | b | 8.8mm | 4.3mm | 5.0mm | 2.0mm | 5.0mm | 2.0mm | 8.8mm | 4.3mm |

FIG. 3B

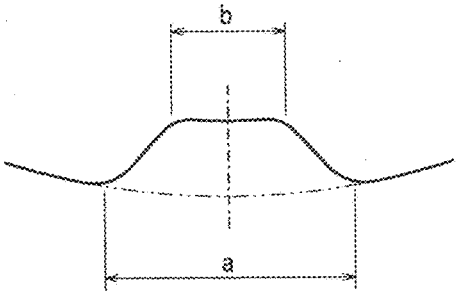

Section of reduced pressure absorbing panel

C-C section

SYNTHETIC RESIN CONTAINER

CROSS-REFERENCE TO RELATED APPLICATION

The present application claims priority to and the benefit of Japanese Patent Application No. 2015-255230 filed on Dec. 25, 2015 and Japanese Patent Application No. 2016-185915 filed on Sep. 23, 2016, the entire contents of which are incorporated herein by reference.

TECHNICAL FIELD

The present disclosure relates to a bottle-shaped synthetic resin container including a mouth portion as a dispensing spout for the contents, a trunk portion extending contiguously with the mouth via a shoulder, and a bottom portion closing a lower end of the trunk portion, especially to such a synthetic resin container including the trunk portion provided with reduced pressure absorbing panels.

BACKGROUND

Due to the light-weight and handleability, the excellent stability for preservation of the content media, and the inexpensive cost, synthetic resin bottles, representatives of which are oriented polypolypropylene (OPP) bottles and polyethylene terephthalate (PET) bottles, are used in various applications, such as beverages, foods, cosmetics, and so forth.

Such a synthetic resin container is known to include the trunk portion provided with reduced pressure absorbing panels to cope with so-called hot filling, in which the contents, such as a beverage, including a juice beverage and tea, and a seasoning, including soy sauce, vinegar, and dressing, are filled at a high temperature heated state. After the contents are hot-filled, the mouth portion is closed with a cap. Then, as the contents are cooled, the inside of the container is placed under reduced pressure, possibly causing the trunk portion to be deformed significantly. To address the above problem, the trunk portion is provided with the reduced pressure absorbing panels, which may be deformed to absorb the reduced pressure inside the container, thereby preventing the entire trunk portion to be deformed significantly.

For example, Patent Literature 1 describes a synthetic resin container including a trunk portion provided with reduced pressure absorbing panels, which extend obliquely in the vertical direction. Thus, the described synthetic resin container prevents deterioration in rigidity otherwise caused by a reduction in thickness of the container. Furthermore, with the reduced pressure absorbing panels that may be deformed to absorb the reduced pressure inside the container, the described synthetic resin container also maintains its appearance shape even when being hot-filled with the contents.

CITATION LIST

Patent Literature

PTL 1: Japanese Patent Application Publication No. 2013-095428

SUMMARY

Meanwhile, a shrink label or a roll label, on which information or the like of the contents may be written, is sometimes applied to an outer circumferential surface of a trunk portion in a synthetic resin container. However, when such a label is applied to the synthetic resin container provided with the oblique reduced pressure absorbing panels as described in Patent Literature 1, a difference between a circumferential length of the reduced pressure absorbing panel portion and a circumferential length of the outer circumferential surface of the trunk portion and a difference between a distance from the central axis of the container to the reduced pressure absorbing panel portion and a distance from the central axis of the container to the outer circumferential surface of the trunk portion cause the following issue. That is to say, the label might get in the reduced pressure absorbing panels, and, when absorbing the reduced pressure, the reduced pressure absorbing panels undergo twisting movement, thereby causing wrinkles on the label. The occurrence of wrinkles is eminent especially in the case of a roll label, which is applied to the trunk portion of the synthetic resin container in a manner such that the entire back surface of the label is glued thereto. Thus, there are the problems that the appearance of the label is deteriorated and that indication on the label is difficult to see. On the other hand, reducing the width in the circumferential direction of each reduced pressure absorbing panel to prevent the occurrence of wrinkles poses another problem of deteriorating mold release properties of the synthetic resin container.

The present disclosure has been conceived in light of the above problems, and the present disclosure is to provide a synthetic resin container that effectively absorbs the reduced pressure generated inside the container as a result of hot filling and that also prevents deterioration in appearance of a label applied to the outer circumferential surface of the trunk portion of the container.

One of embodiments of the present disclosure resides in a synthetic resin container including a mouth portion as a dispensing spout for contents, a trunk portion extending contiguously with the mouth portion via a shoulder portion, and a bottom portion closing a lower end of the trunk portion. The trunk portion is provided with a plurality of reduced pressure absorbing panels that is formed as a plurality of ribs extending in a vertical direction while twisting in a circumferential direction about a central axis of the trunk portion and that is arranged side by side in the circumferential direction of the trunk portion. Each of the plurality of reduced pressure absorbing panels has a panel upper end, a panel lower end, and a narrow-width portion located in a region between the panel upper end and the panel lower end, a width of the reduced pressure absorbing panel being reduced in the narrow-width portion than in the panel upper end and the panel lower end.

Preferably, the narrow-width portion is located at a height corresponding to a middle position between the panel upper end and the panel lower end.

Preferably, the trunk portion is defined and formed by a pair of annular horizontal grooves each extending in the circumferential direction.

Preferably, in the panel upper end and the panel lower end, a width of the reduced pressure absorbing panel on an outer circumferential surface of the trunk portion is 8.8±2.0 mm, and a width of a base surface of the reduced pressure absorbing panel is 80% or less the width of the reduced pressure absorbing panel on the outer circumferential surface of the trunk portion.

Preferably, in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

The present disclosure provides a synthetic resin container that effectively absorbs the reduced pressure generated inside the container as a result of hot filling and that also prevents deterioration in appearance of a label applied to the outer circumferential surface of the trunk portion of the container.

BRIEF DESCRIPTION OF THE DRAWINGS

In the accompanying drawings:

FIG. 3A illustrates a relation between the shape of reduced pressure absorbing panels, and wrinkles on a label and the mold release properties of a synthetic resin container according to one of embodiments of the present disclosure, and FIG. 3B schematically illustrates panel widths a and b illustrated in FIG. 3A;

DETAILED DESCRIPTION

The present disclosure will be described in more detail below by illustration with reference to the drawings.

Figure 1:
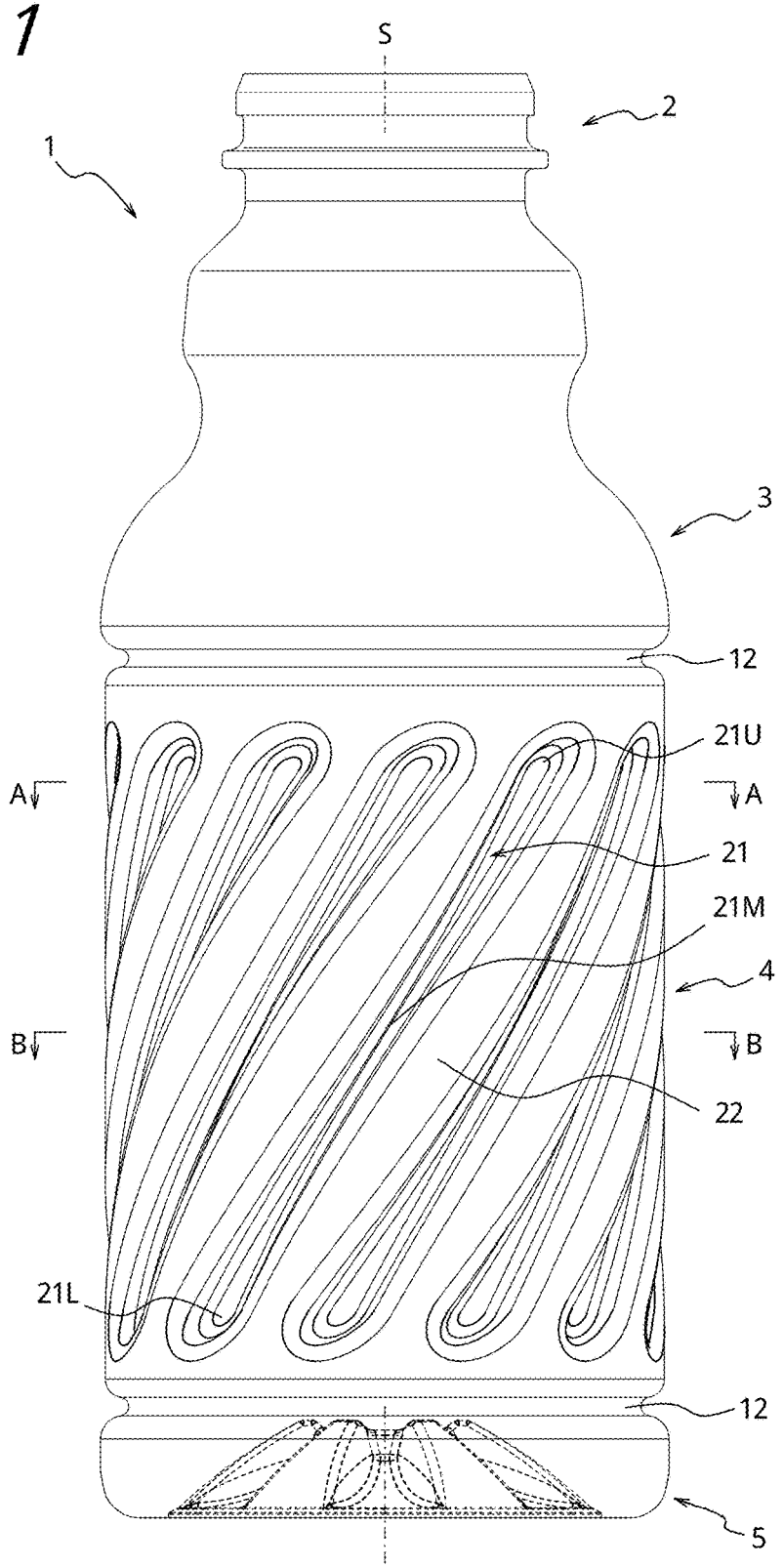
FIG. 1 is a front view illustrating a synthetic resin container according to one of embodiments of the present disclosure.

As illustrated in FIG. 1, a synthetic resin container 1 according to one of embodiments of the present disclosure contains, for example, a beverage, including a juice beverage and tea, and a seasoning, including soy sauce, vinegar, and dressing, as the contents. The synthetic resin container 1 may cope with hot filling, in which the contents are filled at a high temperature heated state, where the contents are heated to a predetermined temperature. Additionally, the vertical direction of the synthetic resin container 1 refers to the upper and lower direction in FIG. 1.

The synthetic resin container 1 is formed in a bottle shape, which includes a mouth portion 2 as a dispensing spout for the contents, a shoulder portion 3, which has a head-cut conical cylinder shape and extending contiguously with a lower end of the mouth portion 2, a trunk portion 4, which extends contiguously with the mouth portion 2 via the shoulder portion 3, and a bottom portion 5, which closes a lower end of the trunk portion 4. Reference numeral S in FIG. 1 denotes the central axis common to the mouth portion 2, the shoulder portion 3, the trunk portion 4, and the bottom portion 5.

The synthetic resin container 1, as a so-called PET bottle, for example, may be manufactured by biaxial stretch blow molding of a polyethylene terephthalate preform. Additionally, the synthetic resin container 1 may also be manufactured by biaxial stretch blow molding of a preform made of any type of thermoplastic synthetic resin, such as oriented polypropylene (OPP), other than polyethylene terephthalate. Furthermore, the method of manufacturing the synthetic resin container 1 is not limited to biaxial stretch blow molding of a preform and may be any of a variety of manufacturing methods, such as extrusion blow molding of a resin material.

The mouth portion 2 has an outer circumferential surface provided with a protrusion. After the contents are hot-filled, the mouth portion 2 is plugged with a cap, which is not illustrated, and thus, the mouth portion 2 may be closed by the undercut fitting. Alternatively, a male screw, instead of the protrusion, may be provided on the outer circumferential surface of the mouth portion 2. In this case, the mouth portion 2 may be closed by the cap being screw-fastened to the male screw.

The trunk portion 4 has an upper end and a lower end, which are each provided with an annular horizontal groove 12, which extends in the circumferential direction over the entire circumference of the trunk portion 4. The horizontal groove 12 is formed in a concave rib shape that is depressed to the inner side in the radial direction of the trunk portion 4 from an outer circumferential surface of the trunk portion 4. By the horizontal grooves 12, the trunk portion 4 is defined and formed with respect to the shoulder portion 3 and the bottom portion 5. Providing the horizontal grooves 12 enhances rigidity in the radial direction of a panel support portion 22, which constitutes the trunk portion 4, in the vicinity of the horizontal grooves 12. This prevents the trunk portion 4 from being collapsed into an asymmetrical shape with respect to the central axis S even in hot filling and maintains the appearance shape of the synthetic resin container 1 steadily.

The present embodiment also presumes that a roll label, on which product information or the like may be written, is applied to the trunk portion 4. A roll label, which is also called a coiled label, is formed as, for example, a rolled film of paper or resin and wrapped around the outer circumferential surface of the trunk portion 4. A roll label made of, for example, paper may be applied to the trunk portion 4 by coating the entire back surface of the paper roll label with an adhesive. In cases of a roll label made of resin, the roll label may be applied by adhering overlap portions located on both ends thereof with use of an adhesive. Importantly, application of a roll label or the like needs to be carried out without causing wrinkles or the like so that product information or the like written on the label is easy to see.

The trunk portion 4 is provided with a plurality of reduced pressure absorbing panels 21, each of which extends in the vertical direction while twisting in the circumferential direction about the central axis S of the trunk portion 4. Due to the twisting in the circumferential direction, the reduced pressure absorbing panels 21 are arranged, with the longitudinal direction thereof being oblique with respect to the vertical direction of the synthetic resin container 1. The reduced pressure absorbing panels 21 are also arranged side by side in the circumferential direction of the trunk portion 4. Additionally, the number of the reduced pressure absorbing panels 21 is determined at will. The reduced pressure absorbing panels 21 are each formed as a rib that is depressed to the inner side in the radial direction of the trunk portion 4 relative to the outer circumferential surface of the trunk portion 4. In a portion between any two adjacent reduced pressure absorbing panels 21, there is also formed a panel support portion 22, which is oblique with respect to the vertical direction. Additionally, in FIG. 1, reference numerals 21 and 22 are respectively assigned only to a single reduced pressure absorbing panel and a single point of the panel support portion for convenience.

Figure 2A:
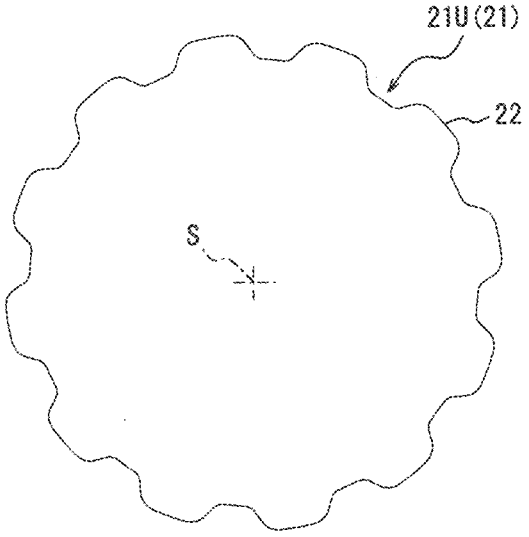
FIG. 2A is a sectional view taken along a line A-A in FIG. 1.
Figure 2B:
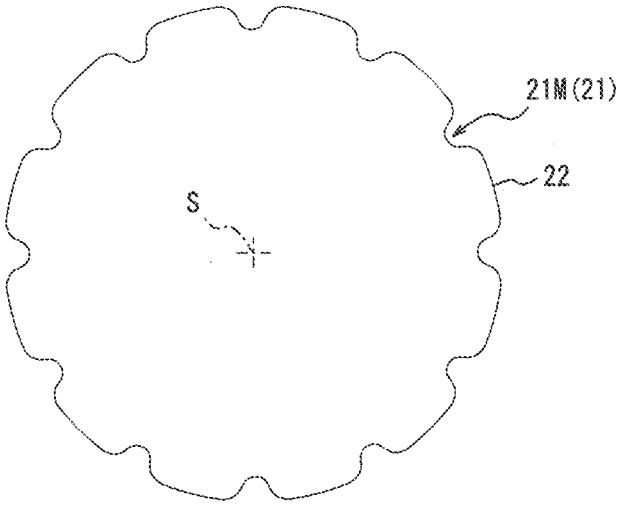
FIG. 2B is a sectional view taken along a line B-B in FIG. 1.

FIGS. 2A and 2B are sectional views of the trunk portion 4 of the synthetic resin container 1 illustrated in FIG. 1. FIG.

Figure 4A:
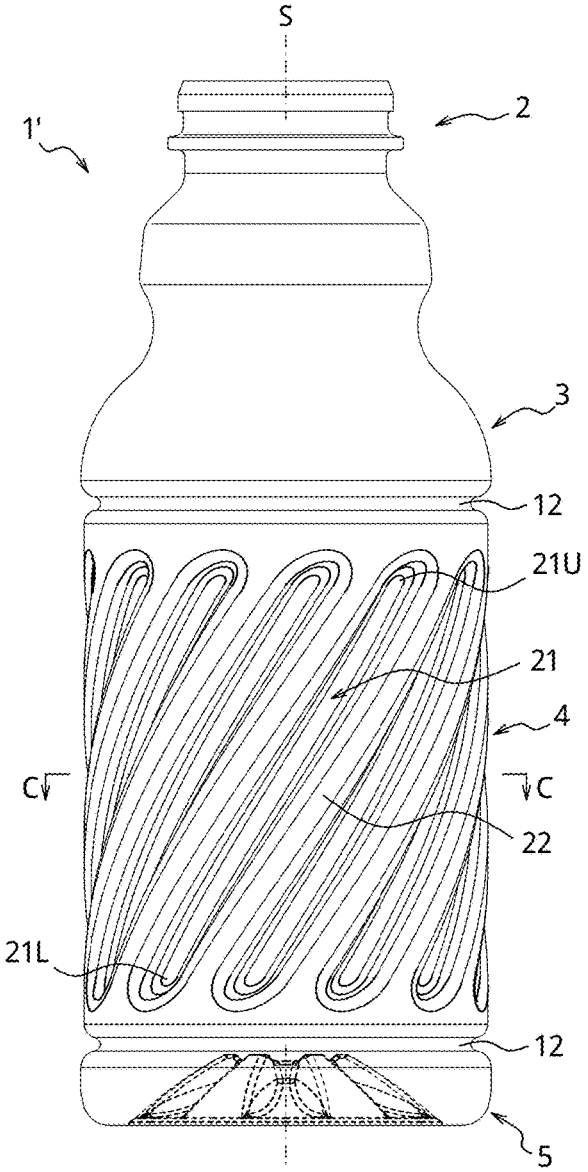
FIG. 4A is a front view of a synthetic resin container including reduced pressure absorbing panels each having a constant width.
Figure 4B:
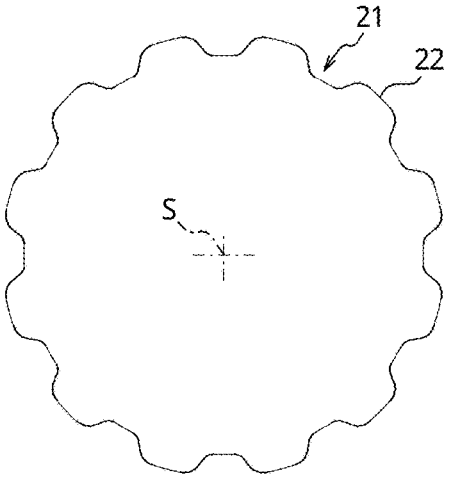
FIG. 4B is a sectional view taken along a line C-C in FIG. 4A.

2A is a sectional view, taken along a line A-A in FIG. 1, of the section of panel upper ends 21U of the reduced pressure absorbing panels 21. FIG. 2B is a sectional view, taken along a line B-B in FIG. 1, of the section of narrow-width portions 21M of the reduced pressure absorbing panels 21. The narrow-width portions 21M are each located at a height corresponding to the middle position between the corresponding panel upper end 21U and the corresponding panel lower end 21L. As illustrated in FIGS. 2A and 2B, each reduced pressure absorbing panel 21 is configured to have a width in the circumferential direction that is reduced in the narrow-width portion 21M, which is located in the middle position, than in the panel upper end 21U. Herein, for comparison, a synthetic resin container 1', in which the reduced pressure absorbing panels 21 each have a constant width, is illustrated in FIGS. 4A and 4B. In the synthetic resin container 1' illustrated in FIGS. 4A and 4B, each reduced pressure absorbing panel 21 may be deformed significantly from the panel upper end 21U through the panel lower end 21L and accordingly, may provide a greater effect of absorbing reduced pressure. However, when a roll label is applied to the trunk portion 4, a difference between a circumferential length of the reduced pressure absorbing panel 21 portion and a circumferential length of the panel support portion 22 and a difference between a distance from the central axis S to the reduced pressure absorbing panel 21 portion and a distance from the central axis S to the panel support portion 22 cause the following issue. That is to say, a slack portion appears on the label in correspondence with the reduced pressure absorbing panels 21, and the label gets into the inner side in the radial direction, and, when the reduced pressure absorbing panels 21 undergo twisting movement, wrinkles appear on the label. On the other hand, reducing the width of each reduced pressure absorbing panel 21 to prevent the occurrence of wrinkles in turn deteriorates mold release properties of the reduced pressure absorbing panel 21 portion. To solve the above problems, as illustrated in FIG. 1 and FIG. 2B, the narrow-width portion 21M is provided in the middle position between the panel upper end 21U and the panel lower end 21L in the present embodiment. The width is configured to change gradually and continuously from the panel upper end 21U and from the panel lower end 21L through the narrow-width portion 21M. With the above configuration, even when a roll label is applied to the trunk portion 4, the slacking of the portion of the label that corresponds to the reduced pressure absorbing panels 21 is prevented by the narrow-width portion 21M, which extends in the vertical direction. Consequently, the occurrence of wrinkles on the label is prevented.

Figure 5A:
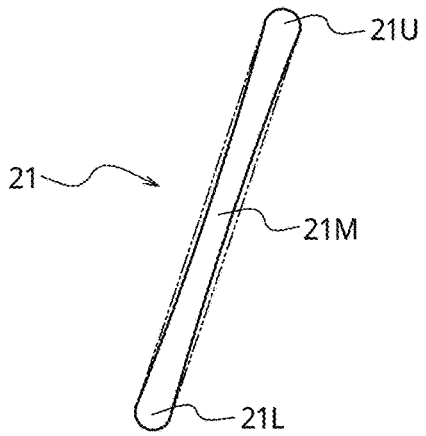
FIGS. 5A to 5C each schematically illustrate the shape of a reduced pressure absorbing panel.
Figure 5B:
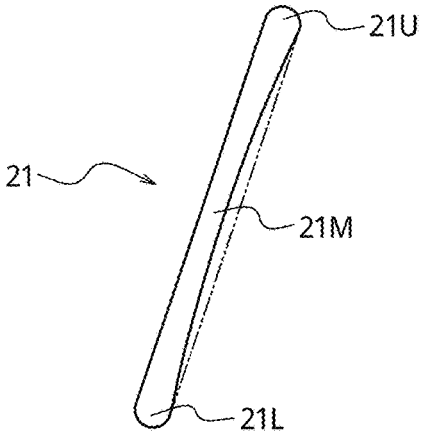
Figure 5C:
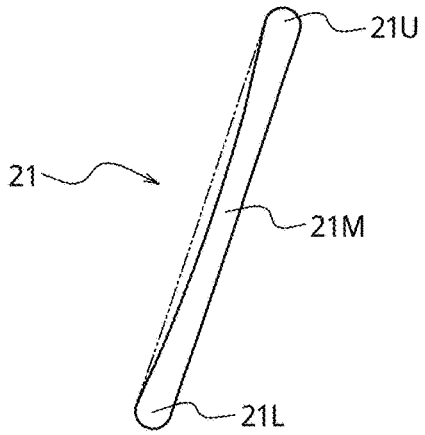

Additionally, the reduced pressure absorbing panels 21 of the synthetic resin container 1', which is illustrated in FIGS. 4A and 4B for comparison, extend in the vertical direction while twisting at a uniform angle in the circumferential direction about the central axis S of the trunk portion 4. Due to the twisting at the uniform angle in the circumferential direction, the longitudinal direction of the reduced pressure absorbing panels 21 is oblique at the uniform angle with respect to the vertical direction of the synthetic resin container 1'. This also applies to the reduced pressure absorbing panels 21 of the synthetic resin container 1 according to the present embodiment as illustrated in FIG. 1. FIG. 5A schematically illustrates the shapes of the reduced pressure absorbing panels 21. FIG. 5A illustrates outlines (i.e., borderlines between the reduced pressure absorbing panels and the outer circumferential surface of the trunk portion 4) of the reduced pressure absorbing panels 21 in an expanded state. In FIG. 5A, a two-dot chain line represents the reduced pressure absorbing panel 21 illustrated in FIGS. 4A and 4B for comparison, and a solid line represents the reduced pressure absorbing panel 21 according to the present embodiment. As illustrated in FIG. 5A, on the basis of the cases (refer to the two-dot chain line in FIG. 5A) where the reduced pressure absorbing panel 21 is oblique at a uniform angle with respect to the vertical direction and has a constant width, the reduced pressure absorbing panel 21 according to the present embodiment is shaped to include the narrow-width portion 21M, which is narrowed equally from both sides in the circumferential direction. However, as illustrated in FIG. 5B, the narrow-width portion 21M may also be formed to be narrowed only from one side in the circumferential direction, and as illustrated in FIG. 5C, the narrow-width portion 21M may also be formed to be narrowed only from the other side in the circumferential direction. Furthermore, the narrow-width portion 21M may be formed to be narrowed unequally from both sides in the circumferential direction. In any cases, the same capacity of reduced pressure absorption may be secured as long as the widths of the narrow-width portion 21M are the same.

In the present embodiment, to improve the mold release properties in the reduced pressure absorbing panel 21, the panel upper end 21U and the panel lower end 21L, which are end portions of the reduced pressure absorbing panel 21 in the vertical direction, are formed to be wide to facilitate mold release. The panel upper end 21U and the panel lower end 21L of the reduced pressure absorbing panel 21 have high rigidity and are difficult to deform due to, for example, the horizontal grooves 12 located in the vicinity thereof. This is why the width of the panel in the panel upper end 21U and the panel lower end 21L is increased. By doing so, the panel upper end 21U and the panel lower end 21L are more likely to be deformed, and the mold release properties are maintained. On the other hand, compared with the panel upper end 21U and the panel lower end 21L, the narrow-width portion 21M has lower rigidity and is easier to deform. Accordingly, even when the width of the panel is reduced in the narrow-width portion 21M, the mold release properties are maintained. With the above configuration, the present embodiment shows no significant difference in mold release properties from the cases where the entire reduced pressure absorbing panel 21 is formed to be wide.

The trunk portion 4 provides the effect of absorbing reduced pressure, by the reduced pressure absorbing panels 21, each of which may be deformed to the inner side in the radial direction, and also by the reduced pressure absorbing panels 21 and the panel support portion 22, which may be deformed with a further greater oblique angle. That is to say, the reduced pressure absorbing panels 21 may undergo twisting movement in a manner such that the panel lower end 21L rotates about the central axis S relatively with respect to the panel upper end 21U. The twisting movement of the reduced pressure absorbing panels 21 and the panel support portion 22 reduces the capacity of the synthetic resin container 1. Accordingly, even when the inside of the container is placed under reduced pressure as a result of hot filling, the reduced pressure absorbing panels 21 and the panel support portion 22 undergo twisting movement, thereby absorbing the reduced pressure.

Thus, in the synthetic resin container according to the present embodiment, the trunk portion 4 of the synthetic resin container 1 is provided with the plurality of reduced pressure absorbing panels 21, each of which extends obliquely in the vertical direction, and moreover, the width of the reduced pressure absorbing panel 21 is reduced in the narrow-width portion 21M than in the panel upper end 21U and the panel lower end 21L. With the above configuration, even though the pressure inside the synthetic resin container 1 is decreased when the contents at a high temperature are cooled after being filled into the container, the capacity of the container is reduced by the twisting movement of the reduced pressure absorbing panels 21, and thus, the reduced pressure is absorbed. Furthermore, even when a roll label or the like is applied to the outer circumferential surface of the trunk portion 4, each narrow-width portion 21M, which is located between the corresponding panel upper end 21U and the corresponding panel lower end 21L and in which the width of the reduced pressure absorbing panel 21 is reduced, minimizes slacking of the roll label. Accordingly, wrinkles are unlikely to appear during the twisting movement of the reduced pressure absorbing panels 21. On the other hand, the panel upper end 21U and the panel lower end 21L are formed to be wide, and therefore, the mold release properties are maintained. Consequently, the synthetic resin container 1 absorbs the reduced pressure generated inside the container as a result of hot filling and also prevents deterioration in appearance of the roll label applied to the outer circumferential surface of the container. The present embodiment provides an especially remarkable effect when the roll label is applied, by coating entire back surface thereof with an adhesive.

Furthermore, since the narrow-width portion 21M is located in the middle position between the panel upper end 21U and the panel lower end 21L, the present embodiment prevents slacking of the roll label more effectively and prevents the occurrence of wrinkles.

Moreover, according to the present embodiment, the trunk portion 4 is defined and formed by the horizontal grooves 12 in the upper end and the lower end of the trunk portion 4. This allows improvement in rigidity in the radial direction of the panel support portion 22, which constitutes the trunk portion 4, in the vicinity of the horizontal grooves 12. Accordingly, the appearance shape of the synthetic resin container 1 is maintained more steadily against hot filling.

EXAMPLES

In the following, to verify the effects of the present disclosure, wrinkles that appear on a roll label and the mold release properties of a synthetic resin container according to Example of the present disclosure were confirmed. The synthetic resin container according to the present Example has the same configuration as the synthetic resin container 1 illustrated in FIG. 1 and is made of polyethylene terephthalate. FIG. 3A shows results of the confirmation. Regarding wrinkles that appear on a label, a rating of "good" indicates that the occurrence of wrinkles was prevented, and "bad" indicates that wrinkles appeared. Regarding the mold release properties, a rating of "good" indicates that the container exhibited good mold release properties, and "bad" indicates that the container exhibited poor mold release properties. As Comparative Examples, three types of containers were prepared. In these three types of containers, the panel widths a and b in the panel upper end 21U and the panel lower end 21L, as well as the panel widths a and b in the middle position between the panel upper end 21U and the panel lower end 21L, were individually varied. The figure includes these containers as Comparative Examples 1 to 3. FIG. 3B illustrates the definitions of the panel widths a and b. In detail, the panel width a is defined as a width of the reduced pressure absorbing panel 21 on the outer circumferential surface of the trunk portion 4, and the panel width b is defined as a width on a base surface of the reduced pressure absorbing panel 21.

As shown in FIG. 3A, Comparative Example 1, in which the panel widths a and b are wide both in the panel upper and lower ends 21U and 21L and in the middle position therebetween, exhibited a high absorption capacity of 29.7 ml and also exhibited good mold release properties. However, the result shows that wrinkles appeared on the roll label. On the other hand, in Example of the present disclosure, although the panel widths a and b in the panel upper end 21U and the panel lower end 21L are wide, the panel widths a and b in the middle position thereof (i.e., the narrow-width portion 21M) are narrow. As a result, although Example exhibited a more or less low absorption capacity of 22.5 ml, good results were obtained for both wrinkles on the roll label and the mold release properties. The reason is that the slacking of the portion of the label that corresponds to the reduced pressure absorbing panels 21 is prevented by the narrow-width portion 21M, which extends in the vertical direction, and the occurrence of wrinkles on the label is prevented. Likewise, regarding the mold release properties, since only the panel upper end 21U and the panel lower end 21L, which have high rigidity and are difficult to deform, are formed to be wide to facilitate mold release, Example maintains good mold release properties.

Additionally, in the synthetic resin container according to the present disclosure, the panel width a of the panel upper end 21U and the panel lower end 21L is preferably 8.8±2.0 mm, and the panel width b of the panel upper end 21U and the panel lower end 21L is preferably within the range from 40% to 80% of the panel width a. Furthermore, the panel width a of the middle position (i.e., the narrow-width portion 21M) is preferably 5.0±2.0 mm, and the panel width b of the middle position is preferably within the range from 40% to 80% of the panel width a. A panel width b of 80% or less of the panel width a provides an appropriate release taper to maintain the mold release properties, and a panel width b of 40% or more of the panel width a allows a sufficient absorption capacity to be maintained.

Comparative Example 2, in which the panel widths a and b are narrow both in the panel upper and lower ends 21U and 21L and in the middle position therebetween, showed a good result in terms of wrinkles on the roll label. However, Comparative Example 2 showed a problematic result in terms of mold release properties. Comparative Example 3, in which the panel widths a and b are narrow in the panel upper and lower ends 21U and 21L and in which the panel widths a and b in the middle position therebetween are wide, has a configuration opposite to the configuration of Example of the present disclosure. Accordingly, Comparative Example 3 showed problematic results in terms of both wrinkles on the roll label and the mold release properties.

Needless to say, the present disclosure is not limited to the above embodiment, and various changes may be made without departing the gist of the present disclosure.

For example, the shape, the number, and so forth of the reduced pressure absorbing panels 21 are not limited to the above embodiment, and various modifications may be adopted.

Furthermore, the location of the narrow-width portion 21M is not limited to the middle position between the panel upper end 21U and the panel lower end 21L, and the narrow-width portion 21M may be relocated upward or downward. Generally, a portion of the synthetic resin container 1 that is located closer to a middle portion (i.e., a portion located at half the overall height) in the vertical direction of the container is more likely to be deformed and exhibits better mold release properties at the time of molding. Accordingly, from the perspective of enhancing the mold release properties of the reduced pressure absorbing panels 21, the location of the narrow-width portion 21M is preferably relocated to be closer to the middle portion in the vertical direction of the synthetic resin container 1. Furthermore, the narrow-width portion 21M may be provided at a plurality of locations between the panel upper end 21U and the panel lower end 21L.

Additionally, the contents filled into the synthetic resin container 1 are not limited to a beverage, including a juice beverage and tea, and a seasoning, including soy sauce, vinegar, and dressing, and any other contents, such as foods and cosmetics, that may be hot-filled may be used.

The invention claimed is:

1. A synthetic resin container comprising a mouth portion as a dispensing spout for contents, a trunk portion extending contiguously with the mouth portion via a shoulder portion, and a bottom portion closing a lower end of the trunk portion, wherein the trunk portion is provided with a plurality of reduced pressure absorbing panels that is formed as a plurality of ribs depressed to the inner side in the radial direction, extending in a vertical direction while twisting in a circumferential direction about a central axis of the trunk portion and that is arranged side by side in the circumferential direction of the trunk portion, areas that are not reduced pressure absorbing panels are located between the reduced pressure absorbing panels in a circumferential direction and extend along the outer circumference of the trunk portion, and each of the plurality of reduced pressure absorbing panels has a panel upper end, a panel lower end, and a narrow-width portion located in a region between the panel upper end and the panel lower end, a width of the reduced pressure absorbing panel in the narrow-width portion being narrower than widths of the reduced pressure absorbing panel in the panel upper end and the panel lower end.

2. The synthetic resin container according to claim 1, wherein the narrow-width portion is located at a height corresponding to a middle position between the panel upper end and the panel lower end.

3. The synthetic resin container according to claim 1, wherein the trunk portion is defined and formed by a pair of annular horizontal grooves each extending in the circumferential direction.

4. The synthetic resin container according to claim 2, wherein the trunk portion is defined and formed by a pair of annular horizontal grooves each extending in the circumferential direction.

5. The synthetic resin container according to claim 1, wherein in the panel upper end and the panel lower end, a width of the reduced pressure absorbing panel on an outer circumferential surface of the trunk portion is 8.8±2.0 mm, and a width of a base surface of the reduced pressure absorbing panel is 80% or less the width of the reduced pressure absorbing panel on the outer circumferential surface of the trunk portion.

6. The synthetic resin container according to claim 2, wherein in the panel upper end and the panel lower end, a width of the reduced pressure absorbing panel on an outer circumferential surface of the trunk portion is 8.8±2.0 mm, and a width of a base surface of the reduced pressure absorbing panel is 80% or less the width of the reduced pressure absorbing panel on the outer circumferential surface of the trunk portion.

7. The synthetic resin container according to claim 3, wherein in the panel upper end and the panel lower end, a width of the reduced pressure absorbing panel on an outer circumferential surface of the trunk portion is 8.8±2.0 mm, and a width of a base surface of the reduced pressure absorbing panel is 80% or less the width of the reduced pressure absorbing panel on the outer circumferential surface of the trunk portion.

8. The synthetic resin container according to claim 4, wherein in the panel upper end and the panel lower end, a width of the reduced pressure absorbing panel on an outer circumferential surface of the trunk portion is 8.8±2.0 mm, and a width of a base surface of the reduced pressure absorbing panel is 80% or less the width of the reduced pressure absorbing panel on the outer circumferential surface of the trunk portion.

9. The synthetic resin container according to claim 1, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

10. The synthetic resin container according to claim 2, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

11. The synthetic resin container according to claim 3, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

12. The synthetic resin container according to claim 4, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

13. The synthetic resin container according to claim 5, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

14. The synthetic resin container according to claim 6, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

15. The synthetic resin container according to claim 7, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

16. The synthetic resin container according to claim 8, wherein in the narrow-width portion, a width of the reduced pressure absorbing panel on an outer circumferential surface of the trunk portion is 5.0±2.0 mm, and a width of a base surface of the reduced pressure absorbing panel is 80% or less the width of the reduced pressure absorbing panel on the outer circumferential surface of the trunk portion.

17. The synthetic resin container according to claim 1, wherein a width of a base surface of the reduced pressure absorbing panel is 80% or less the width of the reduced pressure absorbing panel on the outer circumferential surface of the trunk portion.

* * * * *